United States Patent [19]

Dyck et al.

[11] Patent Number: 4,527,068

[45] Date of Patent: Jul. 2, 1985

[54] CONCRETE SHIELDING HOUSING FOR RECEIVING AND STORING A NUCLEAR FUEL ELEMENT CONTAINER

[75] Inventors: Hans-Peter Dyck, Burgdorf; Harry Spilker, Bad Muender; Heinz-Dieter Gregor, Hanover, all of Fed. Rep. of Germany

[73] Assignee: Deutsche Gesellschaft für Wiederaufarbeitung von Kerbrennstoffen mbH, Hanover, Fed. Rep. of Germany

[21] Appl. No.: 437,749

[22] Filed: Oct. 29, 1982

[30] Foreign Application Priority Data

Nov. 6, 1981 [DE] Fed. Rep. of Germany ..... 3144115

[51] Int. Cl.[3] ..... G21F 5/00

[52] U.S. Cl. ..... 250/507.1; 250/506.1; 252/633

[58] Field of Search ..... 250/506.1, 507.1; 252/626, 633, 628, 631, 632

[56] References Cited

U.S. PATENT DOCUMENTS 3,229,096 1/1966 Bonilla et al. ..... 250/507.1

FOREIGN PATENT DOCUMENTS 2091477A 7/1982 United Kingdom ..... 252/633

OTHER PUBLICATIONS

Nelson et al., "Retrievable Surface Storage Facility . . . ," *Nuclear Technology*, vol. 24, Dec. 1974, pp. 391–397.

*Primary Examiner*—Alfred E. Smith
*Assistant Examiner*—Jack I. Berman
*Attorney, Agent, or Firm*—Walter Ottesen

[57] ABSTRACT

The invention is directed to a concrete shielding housing for receiving and storing a fuel element container filled with spent nuclear reactor fuel elements. The container is suitable for transport and storage. The clear interior dimensions of the concrete shielding housing are somewhat larger than the outer dimensions of the fuel element container. The concrete shielding housing includes a pallet-type base and in the lower region of the housing there is provided at least one air inlet opening and in the upper region of the housing there is provided at least one air outlet opening. To prevent an uncontrolled conduction of moisture away from the interior of the housing to the ground or to the floor of a storage area or building, there is provided a collection pan arranged under the base plate of the pallet-like base. At least one axial bore extends clear through the base plate of the pallet-like base. With the arrangement of the collection pan, contaminated moisture is collected and prevented from seeping into the ground or floor.

4 Claims, 1 Drawing Figure

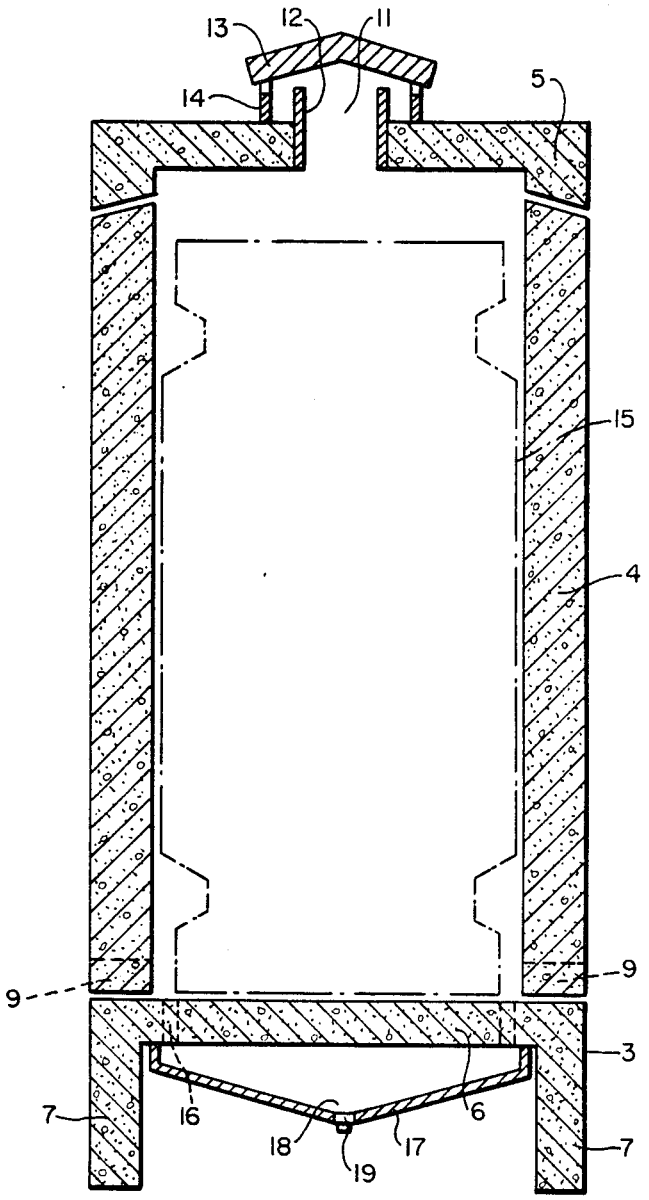
13
12
11
14
5
15
4
9
9
3
7
16
6
18
17
19
7

CONCRETE SHIELDING HOUSING FOR RECEIVING AND STORING A NUCLEAR FUEL ELEMENT CONTAINER

FIELD OF THE INVENTION

The invention relates to a concrete shielding housing for receiving and storing a fuel element container filled with spent nuclear reactor fuel elements. The container is suitable for transport and storage. The clear interior dimensions of the concrete shielding housing are somewhat larger than the outer dimensions of the fuel element container. The concrete shielding housing has a pallet-like base and at least one air inlet opening in the lower region of the housing and at least one air outlet opening in the upper region of the housing.

BACKGROUND OF THE INVENTION

In efforts to provide a temporary storage for fuel element containers in the open, it has been suggested to accommodate the containers in silo-like housings made of concrete or steel-reinforced concrete. In one type of concrete shielding housing, lateral air inlet passages are provided at the lower edge of the housing wall and lateral air outlet passages are provided at the upper edge of the wall underneath the cover. The base of the concrete shielding housng is configured as a separate pallet which can be moved about from one location to another with aid, for example, of a fork-lift truck. The fuel element container and the concrete shielding wall of the concrete shielding housing can be set down on this base. By means of the arrangement of the air inlet and air outlet passages in the concrete shielding housing, a natural ventilation within the housing is obtained for directing away heat produced by the radioactive decay of the materials stored in the container.

In the above-mentioned concrete shielding housing, the base plate of the pallet-like base of the concrete shielding housing is provided with axial bores which extend clear through the base plate and serve as additional air inlet openings. Should moisture form in the interior of the concrete shielding housing, this can be conducted downwardly away from the interior of the housing through these bores.

SUMMARY OF THE INVENTION

It is an object of the invention to provide a concrete shielding housing of the type referred to above wherein an uncontrolled conduction of moisture from the interior of the housing to the ground or to the floor of the storage facility is prevented.

The concrete shielding housing according to the invention includes a pallet-like base having a base plate. The housing has clear interior dimensions somewhat larger than the outer dimensions of the container. Air inlet means are formed in the lower portion of the housing for admitting air into the interior thereof and air outlet means are formed in the upper portion of the housing body for conducting the air away from the housing interior to the ambient. According to a feature of the invention, bore means are formed in the base plate and collection means are arranged beneath the base plate. This collection means communicates with the bore means for receiving and collecting the moisture formed in the interior of the housing.

The bore means can include at least one axial bore which extends clear through the base plate.

The collection means can be in the form of a collection pan which is mounted beneath the base plate of the pallet-like base. The axial bores in the base plate serve on the one hand for ventilating the interior of the housing and, on the other hand, to conduct moisture to the collection pan which has formed in or penetrated the interior of the housing. By means of the arrangement of the collecting pan, contaminated moisture can be collected and its seepage into the ground prevented.

According to another feature of the invention, the collection pan is configured so as to have a location of lowest elevation and a drain plug threadably engages the pan at this location. The collected moisture can in this way be drained from the pan into a transportable container.

BRIEF DESCRIPTION OF THE DRAWING

The drawing shows an elevation view, in section, of the concrete shielding housing of the invention. The drawing also depicts a fuel element container in phantom outline disposed therein.

DESCRIPTION OF THE PREFERRED EMBODIMENTS OF THE INVENTION

The concrete shielding housing includes a pallet-like base 3 upon which is placed a cylindrical concrete shielding wall 4. A cover 5 forms part of the housing and lies upon the concrete shielding wall 4.

The base 3 includes a square base plate 6 having feet 7 mounted at respective corners of the base plate 6 so that the base 3 is configured as a pallet accessible from beneath for moving the same from one location to another. The cylindrically formed concrete shielding wall 4 is placed upon the base 3 and is aligned by means of a suitable centering arrangement (not shown).

The concrete shielding wall 4 is provided with openings 9 at the lower end thereof and these openings serve as lateral air inlet passages. The cover 5 lying upon the wall 4 includes an air outlet opening 11 at its center which is surrounded by perpendicular plates 12. A roof-like cover 13 extends over the air outlet opening 11 and is supported by supports 14 mounted on the cover 5.

A fuel element container 15 is shown in phantom outline and is standing on the base plate 6 of the base 3. Axial bores 16 extend clear through the base plate 6 and communicate at their lower ends with the collection pan 17. The collection pan 17 is securely mounted to the lower side of the base plate 6. The collection pan 17 is formed so that it has a point of lowest elevation at the center thereof. At this deepest location 18 of the collection pan 17, a drain plug 19 is provided which threadably engages the pan. The drain plug permits moisture collected in the pan to be drained therefrom.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

What is claimed is:

1. A concrete shielding housing for receiving and storing a transportable fuel element container which is suitable for storage and filled with spent nuclear reactor fuel elements, the housing comprising:

a pallet-like base having a base plate;

the housing having clear interior dimensions somewhat larger than the outer dimensions of the container;

air inlet means formed in the lower portion of said housing for admitting air into the interior thereof;

air outlet means formed in the upper portion of said housing for conducting air from said interior to the ambient;

bore means formed in said base plate; and collection means arranged beneath said base plate and communicating with said bore means for receiving and collecting moisture formed in said interior of said housing.

2. The concrete shielding housing of claim 1, said collection means being a collection pan disposed beneath said base plate and mounted to said base.

3. The concrete shielding housing of claim 2, said collection pan being configured so as to have a location of lowest elevation, and a drain plug threadably engaging said pan at said location.

4. The concrete shielding housing of claim 1, said bore means being a plurality of bores formed in said base plate for conducting away moisture formed in said interior; and, said collection means communicating with said plurality of bores for receiving and collecting the moisture formed in said interior of said housing.

* * * * *